US007050590B2

(12) United States Patent
McPherson et al.

(10) Patent No.: US 7,050,590 B2
(45) Date of Patent: May 23, 2006

(54) METHOD AND APPARATUS FOR CHECKING AUDIO SIGNALS

(75) Inventors: Alan J. McPherson, Chatsworth, CA (US); George H. Lydecker, Burbank, CA (US)

(73) Assignee: Warner Music Group, Inc., New York, NY (US)

( * ) Notice: Subject to any disclaimer, the term of this patent is extended or adjusted under 35 U.S.C. 154(b) by 631 days.

(21) Appl. No.: 10/024,406

(22) Filed: Dec. 18, 2001

(65) Prior Publication Data

US 2002/0118842 A1 Aug. 29, 2002

Related U.S. Application Data

(60) Provisional application No. 60/256,265, filed on Dec. 18, 2000.

(51) Int. Cl.
*H04R 29/00* (2006.01)

(52) U.S. Cl. ..... 381/56; 381/12

(58) Field of Classification Search ..... 381/58, 381/59, 56, 12, 1; 345/727, 728, 729, 730, 345/204; 73/587; 382/311; 348/725
See application file for complete search history.

(56) References Cited

U.S. PATENT DOCUMENTS 5,272,756 A * 12/1993 Tanaka et al. ..... 381/12
5,274,708 A * 12/1993 Fields et al. ..... 381/1
6,388,681 B1 * 5/2002 Nozaki ..... 345/764
6,408,301 B1 * 6/2002 Patton et al. ..... 707/102
6,771,826 B1 * 8/2004 Boon ..... 382/238

* cited by examiner

*Primary Examiner*—Ping Lee
(74) *Attorney, Agent, or Firm*—Gottlieb, Rackman & Reisman, P.C.

(57) ABSTRACT

A test signal generator adapted to generate a test signal for an audio program having at least a left and right program track, the test signal generator including a memory means holding digital data descriptive of a unique image; and converter adapted to convert the digital data into a pseudo audio test signal having a left test track and right test track. The pseudo audio test signal is attached or mixed with the respective audio program and the resulting composite signal is recorded on a respective media and/or transmitted by other means to a remote location. At the remote location, the test signal is separated and displayed using the left track and right tracks as two orthogonal components to generate a reproduction of the image. The relative orientation, spatial and geometric characteristics of the reproduced image is indicative of various parameters of the received audio program.

16 Claims, 9 Drawing Sheets

Vector Graphic

Waveform

X Y Scope Display

Phase OK

18 Fig. 4a

L phase is 180

14 Fig. 4b

R phase is 180

15 Fig. 4c

Polarity Reversed

16 Fig. 4d

L and R = R and L

17

7.5 ips 15 ips 30 ips

METHOD AND APPARATUS FOR CHECKING AUDIO SIGNALS

This application claims priority to provisional application Ser. No. 60/256,265 entitled "Method of using test signals in a 2-channel system to determine absolute polarity phase and channel reversal" filed Dec. 18, 2000 and incorporated herein by reference.

BACKGROUND OF THE INVENTION

A. Field of Invention

This invention pertains to a method and apparatus for testing audio programs, and more particularly to a means for determining rapidly the proper phase and polarity and other characteristic parameters of stereo audio signals of said programs through visual inspection. The method and apparatus include generating a unique test signal which can be used to generate an image indicative of various characteristic parameters associated with test signal and the related.

B. Description of the Prior Art

Standard recordings of stereo audio programs, for example, master tapes, digital audio files, and analog or digital video files, consist of stereo signals having certain characteristic parameters, such as phase and polarity. These characteristic parameters must be preserved while of the programs are copied or transmitted to a remote location to insure that they can be replayed as accurately as possible. Preserving these characteristic parameters also insure that the artistic rendition of the programs are not compromised by errors.

The usual technique used to verify these characteristic parameters consists of inserting test signals (typically sinusoidals) at the beginning of each audio program. The recorded or transmitted program is then checked by displaying the test signals on a graphic analyzer, such as an X-Y oscilloscope. More specifically, the test signals on the left channel are connected to the X input of the oscilloscope (corresponding to the horizontal axis), and the test signals on the right channel are connected to the Y input of the oscilloscope (corresponding to the vertical axis). The image generated by the oscilloscope is then inspected by a skilled operator.

A disadvantage of this method is that the operator needs a high level of skill and experience to identify and correct any recordal or transmission problems since they are not patently obvious. In addition, sinusoid test signals are useful to identify some but not all of the problems that can occur while a program is recorded or transmitted. For example, the method is not capable of identifying an absolute phase reversal, wherein the phase of the signals of both the left and the right channels are reversed. Moreover, the existing technique cannot be used to determine whether the program has been copied improperly or otherwise duplicated using some encoding and decoding non-linear schemes In order to assure uniformity and accuracy in the copying and transmission of stereo programs, various national and international organizations have promulgated standards for stereo audio programs. Some of these standards define the proper phase and polarity parameters of the stereo audio signals on each channel. However, the standards do not specify any techniques for determining, or testing that recorded or transmitted programs include stereo signals with the correct phase and polarity.

OBJECTIVES AND SUMMARY OF THE INVENTION

In the view of the above-mentioned disadvantages of the existing technique, it is an objective of the present invention to provide a method and technique to quickly identify that the audio signals of a stereo program have the correct polarity and phase.

A further objective is to provide a method and apparatus of generating or providing a special test signal, which can be used to check and diagnose the connection of stereo equipment.

A further objective is to provide a method and apparatus of providing a stereo program including specialized test signals, which can aid in the identification of the owner or source of the program, whether that program is recorded in the form of digital sound file, recorded on an audio or videotape, tape, or transmitted via a carrier.

A further objective of this invention is to provide a means of identifying if an audio program has been copied in such a way as to cause corruption of the audio channels.

Other objectives and advantages of the invention shall become apparent from the following description of the invention.

Briefly, according to this invention, a unique image is first generated. The image may be arbitrary, may consist of a logo, or may be any other image. A set of orthogonal components are extracted from the image and used to generate a pseudo audio digital file therefrom having characteristics of a stereo audio file. This pseudo audio digital file is attached or interleaved with the digital signals of the audio program and the resulting combined audio program is recorded and or transmitted to a remote location.

In order to test the integrity and accuracy of the combined program after it has been recorded or transmitted, the pseudo audio file is separated therefrom, the orthogonal components are generated from this latter file and then used to create a respective image on an appropriate device, such as an oscilloscope to be viewed by a technician. The unique image as it is displayed has certain spatial and geometric characteristics such as, position, orientation and quality and dimensions that are related to the characteristic parameters of the audio program and hence the image can be used as a diagnostic tool.

In one aspect of the invention, the present invention pertains to a method of testing an audio program having at least a first audio and a second audio channel, the method comprising:

generating a pseudo audio test signal having a first and a second channel that define a unique image;

attaching said pseudo audio test signal to said audio program to form a combined audio program;

recording said composite audio program on an audio media;

reading said composite audio program from said audio media;

detecting said pseudo audio test signal from said composite audio program; and displaying said unique image, wherein said unique image, when displayed, has geometric and spatial characteristics that are indicative of characteristic parameters of the audio program.

In another aspect of the invention, a test signal generator adapted to generate a test signal for an audio program having a left and right program track is disclosed, the said test signal generator comprising:

memory means holding digital data descriptive of a unique two dimensional image; and converter means adapted to convert said digital data into a pseudo audio test signal having a left test track and right test track.

BRIEF DESCRIPTION OF THE DRAWINGS

FIGS. 4*a*–4*e* shows different orientations of the image of FIG. 3*c* for various erroneous parameter characteristics.

DETAILED DESCRIPTION OF THE INVENTION

Figure 1:
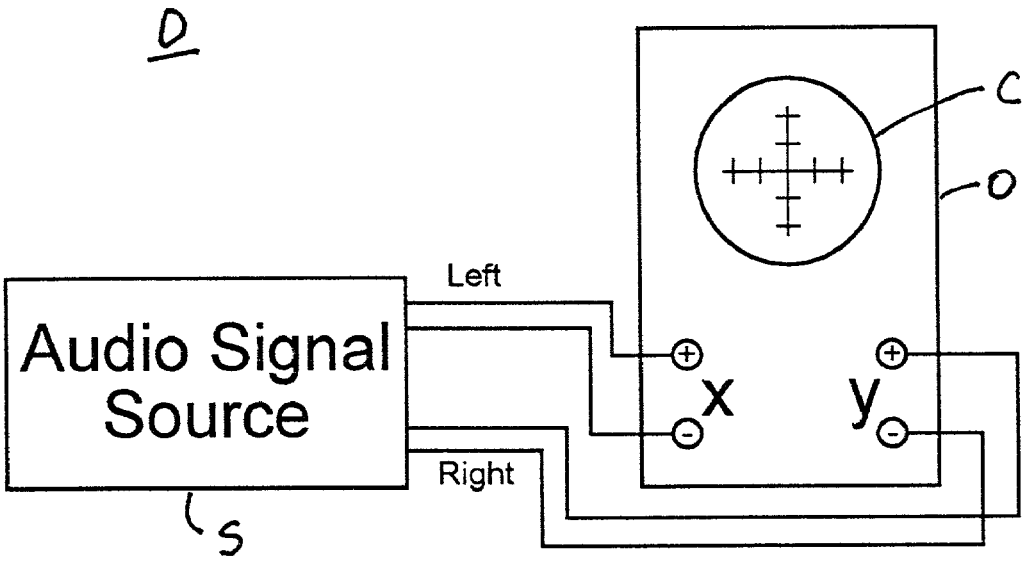
Fig 1 PRIOR ART
FIG. 1 shows a block diagram of a prior art test device for checking audio programs.

FIG. 1 shows a block diagram of a prior art test device D used to check a stereo program from an audio signal source S. The source S may be a tape player adapted to play a master tape, a DVD player, or any other type of device that can be used to play the test signals associated with an audio program that has been previously recorded or transmitted. The device D further includes an oscilloscope O having two input terminals X and Y and a screen C. The oscilloscope is adapted to generate an image on its screen C representative of the signals coupled to input terminals X and Y. More specifically, the oscilloscope generates a two-dimensional image using Cartesian coordinates with the signal on terminals X defining the components of the image along the X or horizontal axis and the signal on terminal Y defining the Y or vertical components.

Typically, as shown in FIG. 1, the source C generates test sinusoidals having waveshapes similar to audio signals on a left and a right channel, with the left channel being connected to the X terminals and the right channel being connected to the Y terminals as shown. If a test signal consisting of two identical sinusoidal signals is obtained from the source S, then the oscilloscope O generates a straight line disposed at an angle related to the relative amplitudes of the test sinusoidals. If the test sinusoidals are out of phase by 90° then the oscilloscope generates the image of a circle or an ellipse.

In this manner the device D allows an audio production engineer to quickly evaluate by visual indication the correct phase and amplitude of test sinusoidals associated with the audio program being reproduced by the source S. However using identical test sinusoidals on both the left and right channels of the audio media does not allow the operator to check whether the left and right channels are reversed, or whether the absolute phases of sinusoidals are correct.

The present inventors have discovered that much more information can be obtained if instead of mere sinusoidals, a pseudo audio test signal can be represented by a unique, preferably asymmetrical, image on an oscilloscope or other similar graphic device. FIG. 2*a* shows a block diagram of an apparatus that may be used for generating such a test signal and FIG. 2 shows a flow chart of the steps performed by the apparatus of FIG. 2*a*.

It should be understood that apparatus 100 is shown as having discrete elements for the sake of clarity, it being understood that the apparatus 100 may be implemented by a PC or other microprocessor-based equipment, in which case the elements of FIG. 2*a* are implemented by software.

The apparatus 100 of FIG. 2*a* includes a memory 102, a Cartesian converter 104, X- and Y-component extractors 106, 108 and a combiner 110. The memory 102 is used to store data representative of a unique image. The image may be arbitrary, it may be a logo, or can be any other type of image. Preferably, the image is stored in the memory 102 in a format that may be readily decomposed into two orthogonal components. For example, the image may be a vector image such as DXF, EPS (Encapsulated Post Script), Gerber, and G-code. The inventors have found that an image using a DXF is particularly useful for the purposes of this invention.

Figure 2:
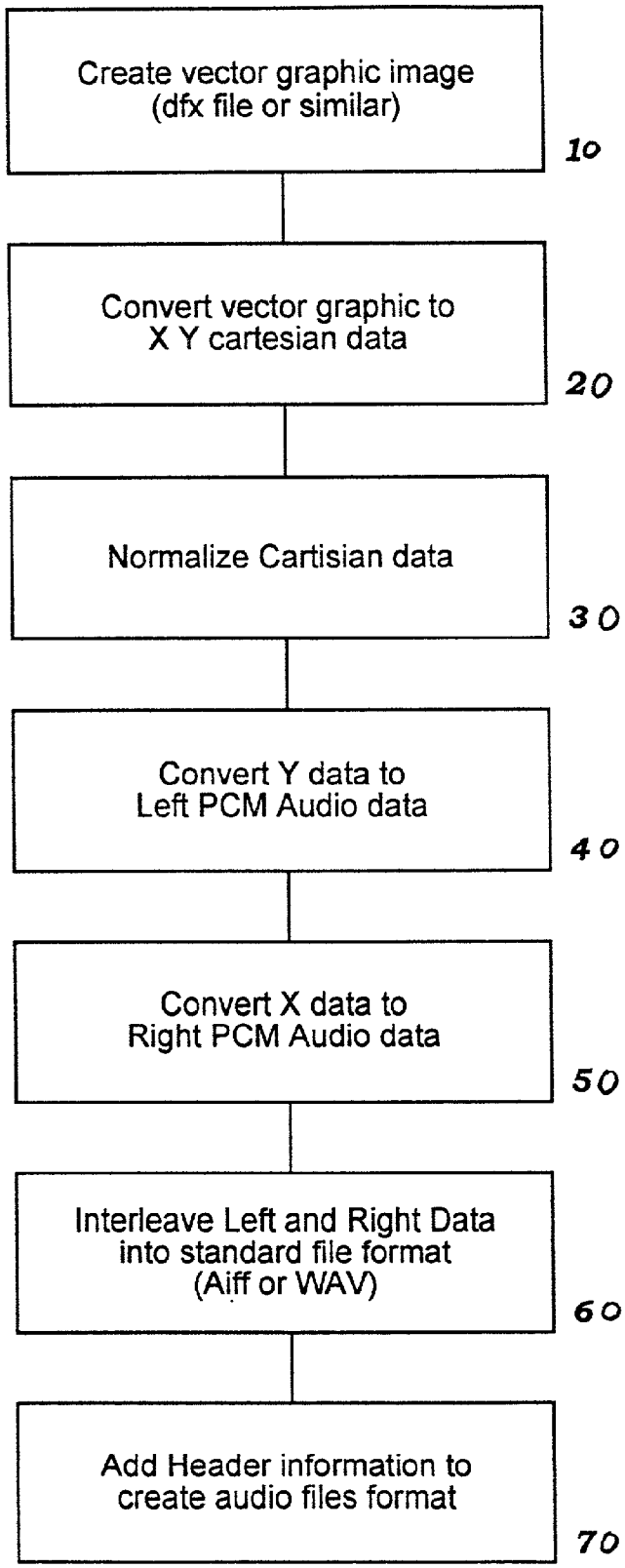
FIG. 2 shows a flow chart for creating the audio test file from a vector graphic image.
Figure 2A:
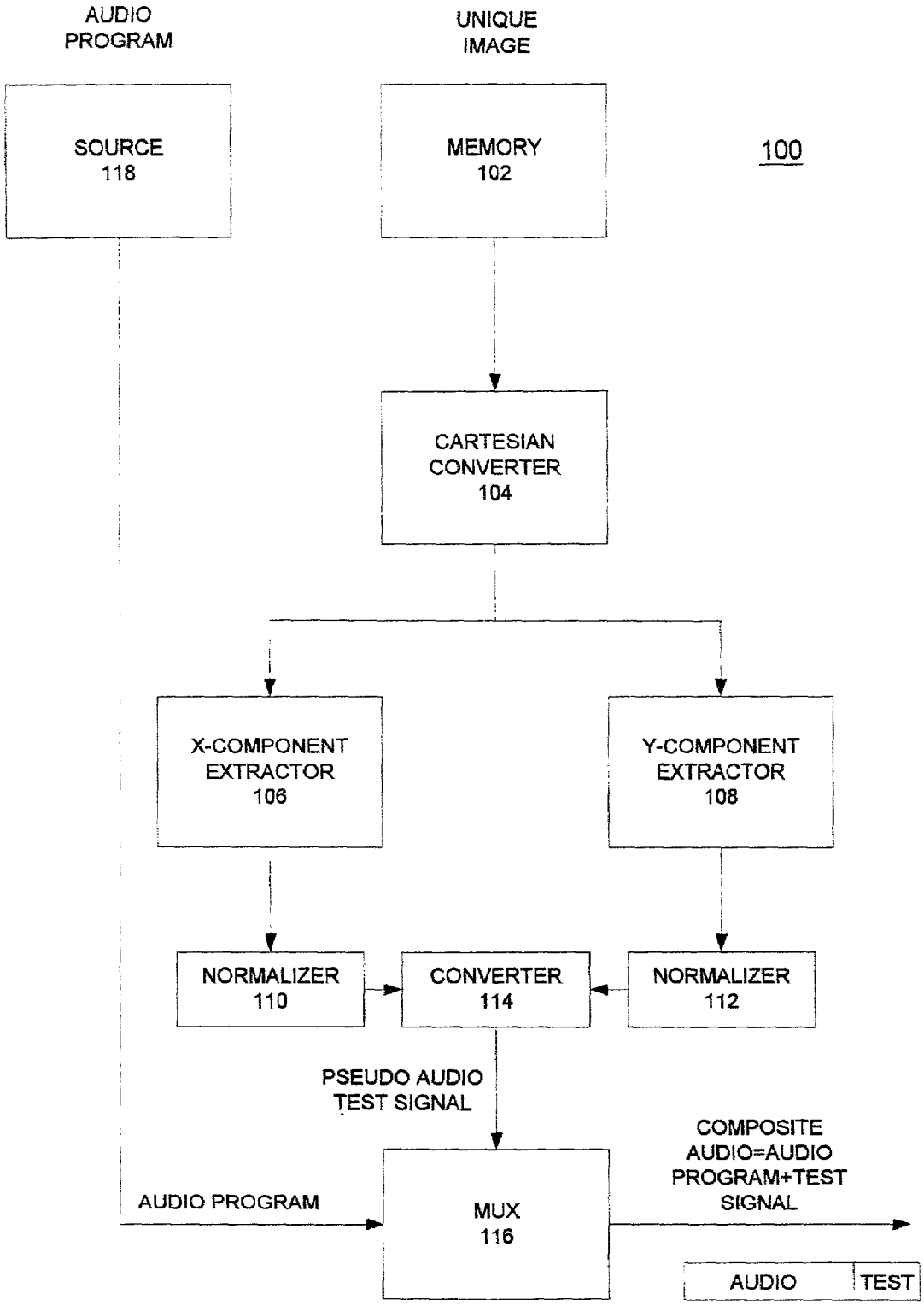
FIG. 2*a* shows a block diagram of an apparatus used to generate a digital test signal corresponding to the image of FIG. 2.

As shown in FIG. 2 the first step 10 involves creating the two dimensional graphic image using drawing or CAD program and stored as a graphic file in memory 102. If this graphic file is in a standard file format such as DXF the values of its X- and Y-components are easily obtainable. If other formats are used, the graphic file is retrieved from the memory 102 and converted into a Cartesian format by Cartesian converter 104.

Next, in step 20 the extractors 106, 108 extract the X- and Y-components of the image, respectively. In step 30 the X- and Y-components are normalized by normalizers 110, 112 respectively to insure that the components extracted from the graphic file and normalized so that their largest values do not exceed the possible range of the audio signals of the respective program. For example for an eight bit audio signal, the range expected range is 256, where 256 is the maximum value allowed for the audio signals.

Figure 3A:
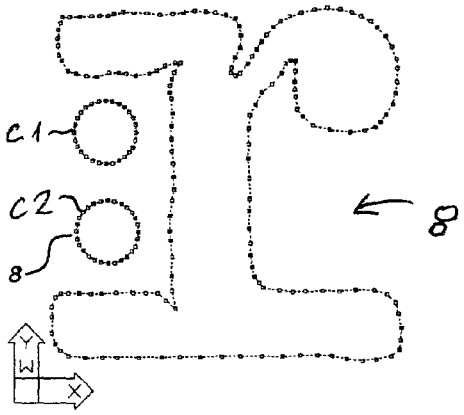
FIG. 3*a* shows a vector graphic image that may be used for a test signal in accordance with this invention.
Figure 3B:
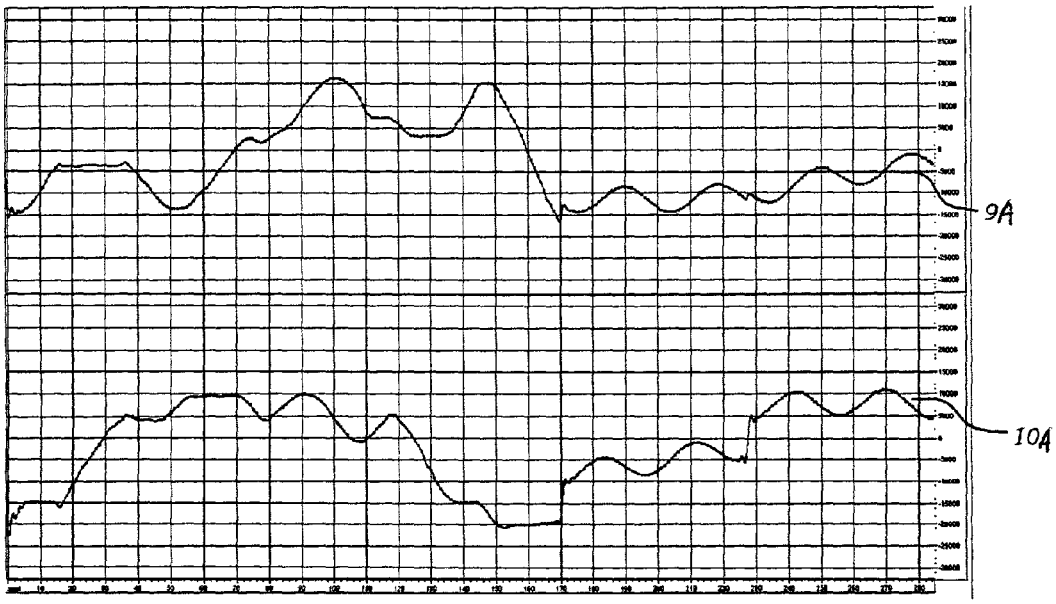
FIG. 3*b* shows the left (top) and right (bottom) test signals corresponding to the image of FIG. 3*a* for a complete cycle, using a PCM waveform.

FIG. 3*a* shows an actual vector graphic image 8 that can be used for a test signal. FIG. 3*b* shows the resultant right and left audio waveforms 9A and 10A from the respective X- and Y created from the vector graphic.

Typically, an audio program is provided in a digital format (for example, AIFF or WAV). After the components have been normalized, they are converted into a format compatible or identical with the format of the respective audio program. This conversion is performed by the converter 114 (Steps 40 and 50). As part of this conversion, the components are encoded using, for example, a known PCM encoding algorithm. The output of the converter 114 is a digital test signal having characteristics very similar to a digital audio file and hence, it is referred to herein as a pseudo audio file.

The final step 60 is to pack or interleave the binary data of the pseudo audio file in a proper byte order with the digital audio program from source 118. This byte order can vary between file formats. This step is performed by multiplexer (MUX) 116. The resulting composite audio file includes both the actual audio program and the pseudo audio file that can be used as a test signal to test the integrity and other characteristics of the audio program.

Optionally, multiplexer 116 also attaches a header to the test signal (step 70) to identify the program generated by the multiplexer as one having a digital test signal, and to provide other data related to the audio program and its contents.

As shown at its output, the Mux 116 can be said to generate an output consisting of a digital audio file which corresponds to the program from buffer 118 and a pseudo-audio file corresponding to the image from memory 102. The two audio files are encoded using a common format (e.g., WAV) and are virtually indistinguishable.

Figure 2B:
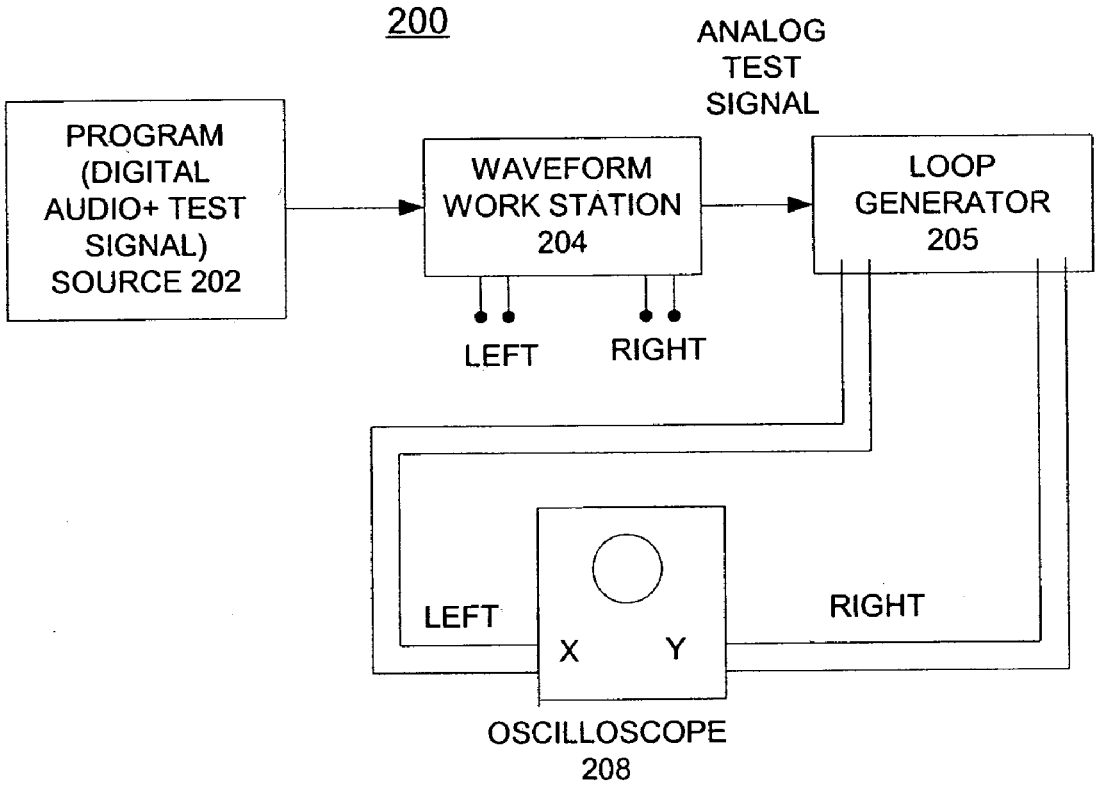
FIG. 2*b* shows a block diagram of an equipment adapted to show the audio test signal as a test image corresponding to the graphic image of FIG. 2.

FIG. 2*b* shows a test equipment 200 used to generate images based on the digital test signal. The equipment 200 receives the composite digital file from source 202 (where the source could include any means or media on which the composite file recorded or stored after being received). Test equipment 200 includes waveform work station 204, a loop generator 205, and an oscilloscope 208 similar to the one in FIG. 1.

The waveform work station 204 decodes the composite program file from source 202 and generates a multichannel analog audio signal on a left and a right channel so that it can be replayed on respective left and right speakers (not shown). In addition, the station 204 also generates an analog test signal, having its own right and a left channel.

Preferably, in order to simplify processing and save time and bandwidth, the waveform shown in FIG. 3*b* defines a single instant or cycle of the respective image. This signal can be fed directly to the oscilloscope 208 directly, however the oscilloscope must have some internal memory or other means to capture and hold the image so that it can be reviewed for a prolonged time. Alternatively, as shown in FIG. 2*b*, the analog test signal is fed to a loop generator 205 that generates a loop for image to prolong it either indefinitely, or for a predetermined amount of time. The prolonged image is then fed to the oscilloscope 208. However, preferably, the loop generator 205 copies the analog signal a predetermined number of times and then transmits each copy of the image repeatedly to the oscilloscope. Again, this process can occur either indefinitely, or as long as a user wants to see the image.

Figure 3C:
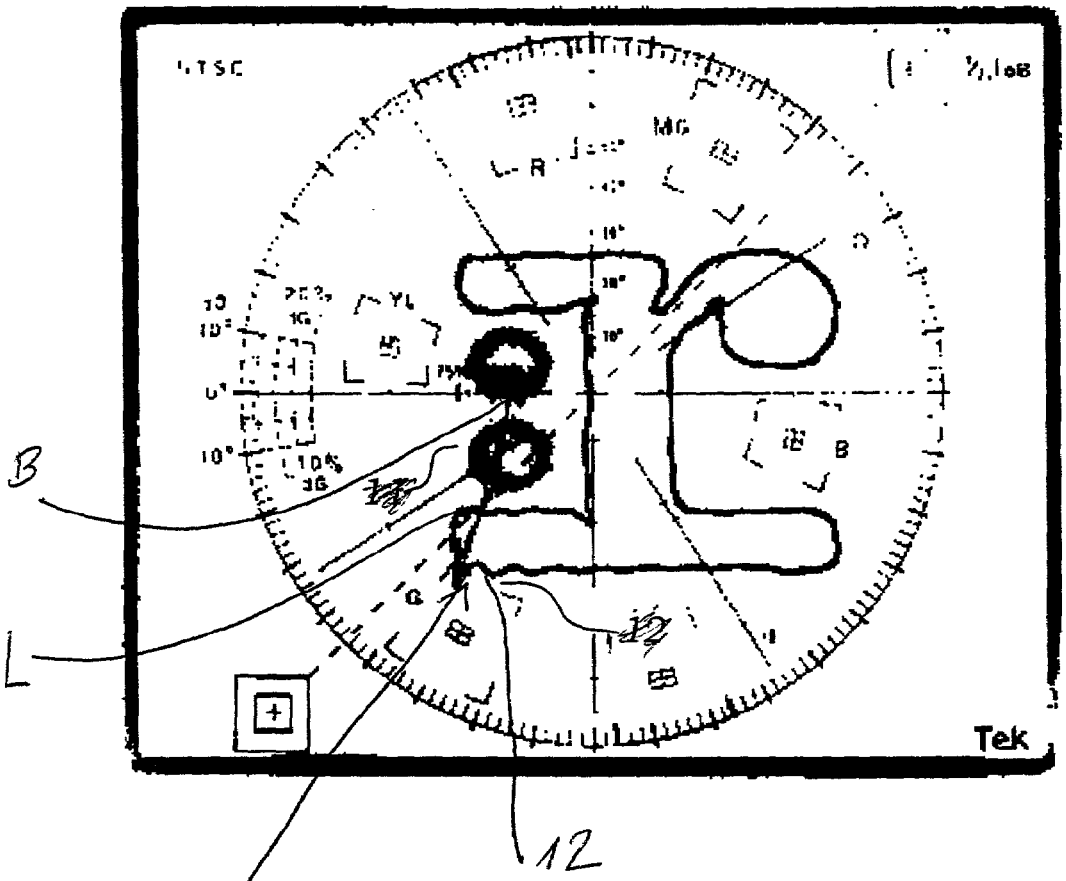
FIG. 3*c* shows the image seen on the graphic image display of FIG. 1 using the test signals of FIG. 3*b;*

FIG. 3*c* shows an actual image on an oscilloscope obtained by the device 200 of FIG. 2*a* using the test signal generated as discussed above. Preferably, the image 8 is selected so that as the oscilloscope traces or 'paints' the image on its screen with its beam, the beginning point and end point of each trace are as close to each other as possible. For example, for the image shown in FIG. 3*c* the beginning point is at B, the ending point is at E and the line L is the retracing line as the beam switches from the ending of one trace to the beginning of the next. The reason why points B and E should be close is to reduce ringing that can occur, as illustrated in FIG. 3*c* at 12.

Figure 4E:
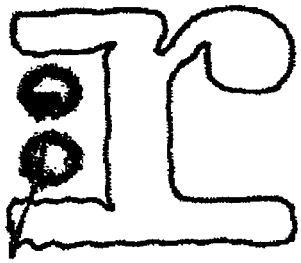
Figure 4E:
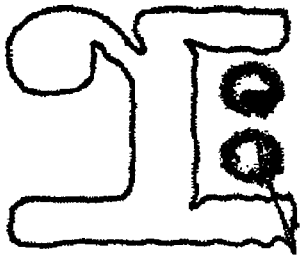
Figure 4E:
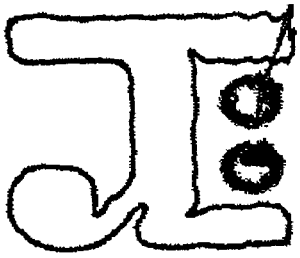
Figure 4E:
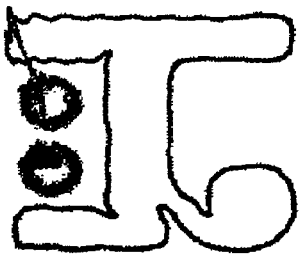
Figure 4E:
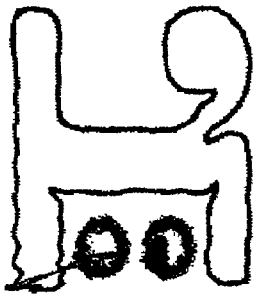

FIGS. 4*a–e* show somewhat diagrammatically examples of various images that are generated by the device 200 to demonstrate the diagnostic capacities of the invention. In FIG. 4*a* the image 8 if FIG. 3*a* is repeated to provide a proper frame of reference and shows the image resulting from a pseudo audio file from a composite audio file that has been transmitted or recorded correctly, i.e., with the proper phase and polarity. FIGS. 4*b* and 4*c* show the resultant image when the left and right channel are out of phase by 180°, respectively.

FIG. 4*d* shows the image 14 resulting when the polarity of both the left and right channels are reversed.

FIG. 4*e* shows the image 15 obtained when the right and left channels are interchanged, causing the image to appear mirrored and rotated 90 degrees clockwise.

Other problems can be diagnosed by using the test signal as well and the graphic samples shown in FIGS. 4*a–e* are merely illustrative. For example, delays between the right and left channels can result in a skewed image.

Figure 5A:
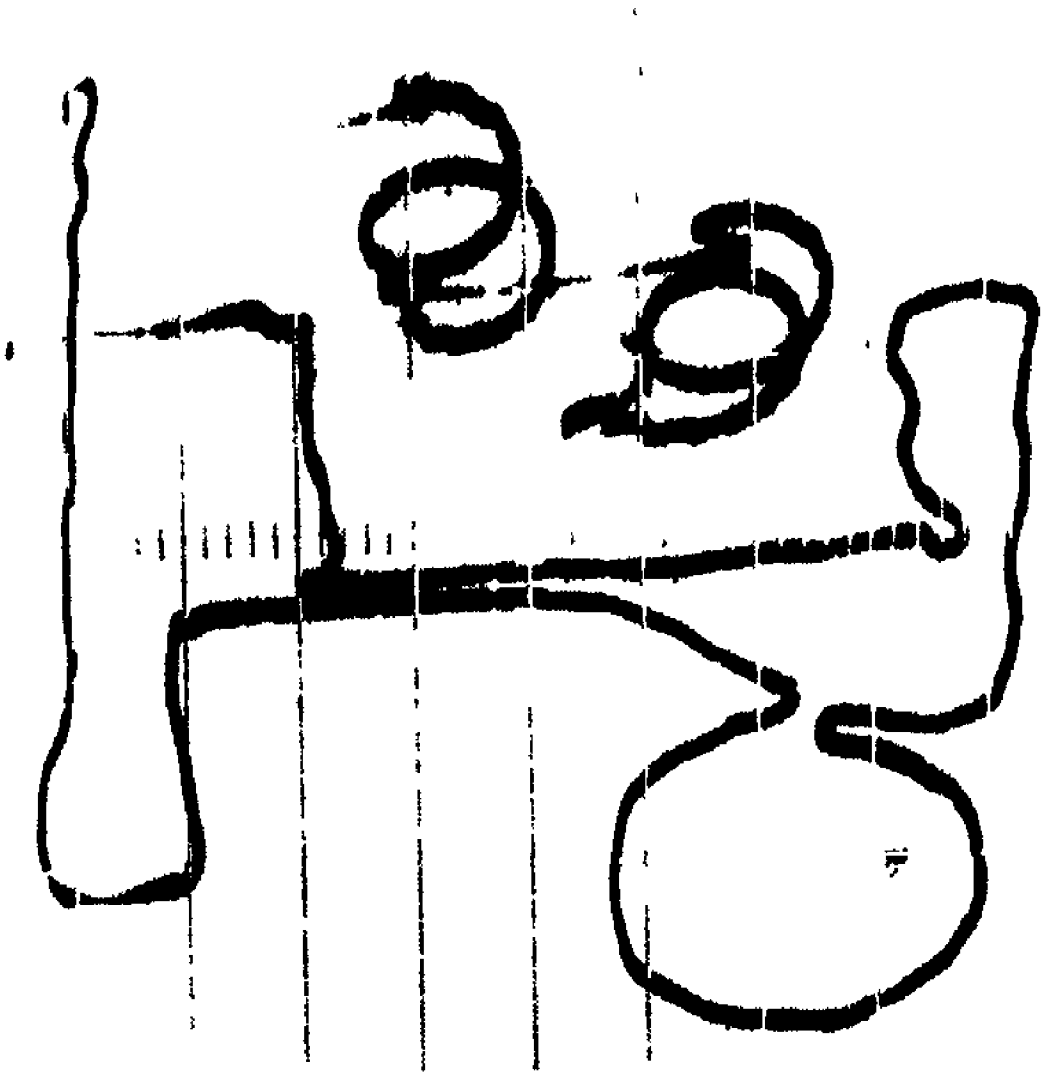
FIGS. 5*a*–5*c* show distortions on the image of FIG. 3*c* when an audio file is recorded on a magnetic tape at 7.5 ips, 15 ips and 30 ips, respectively.
Figure 5B:
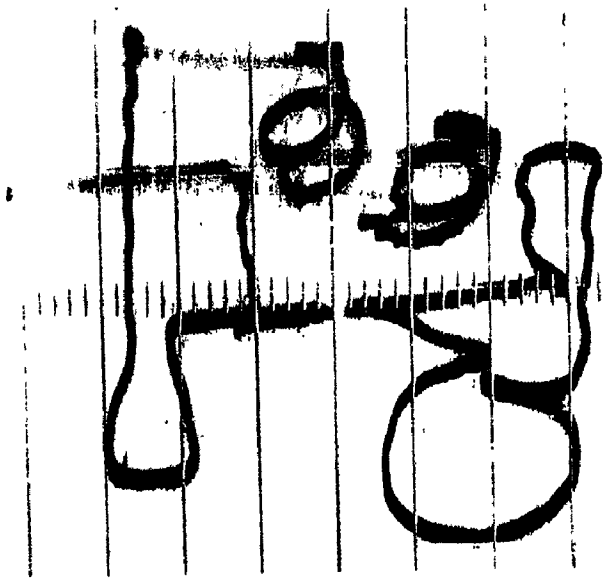
Figure 5C:
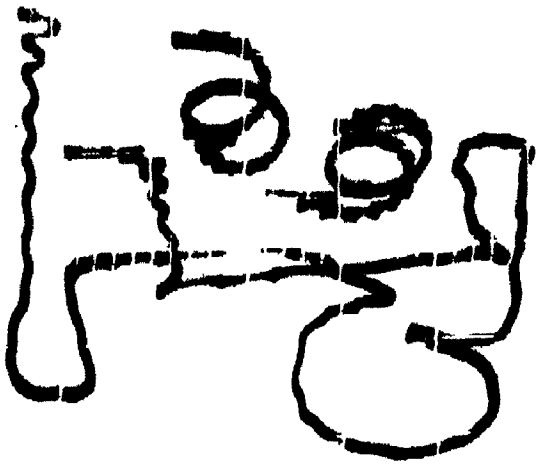

General distortion of the image indicates that the audio may have been transferred to an analog media such as an analog tape. This distortion is caused by the characteristics of the analog magnetic media and the play back process. The process of reproducing sound from an analog magnetic media relies on a voltage induced in a play back head by magnetic flux lines as the magnetic media moves relative to the head. The amplitude of the voltage is related to the rate of change of the magnetic flux. As a result, the voltage signals generated from the magnetic media is a differential function of the original signal recorded on the media, thereby causing sinusoidal components to be shifted by 90° in phase, and square waves to be reproduced as a series of impulses. FIGS. 5*a–*5*c* show the distortions resulting when the analog test signal corresponding to the image of FIG. 3*c* is recorded on a magnetic tape at 7.5, 15 and 30 ips, respectively. Other forms of image degradation can also be caused by digital compression where the phase information in the audio has been discarded.

Obviously, numerous modifications may be made to this invention without departing from its scope as defined in the appended claims. For example, instead of an oscilloscope, other means may be used to generate the graphic image 8. Moreover, while the detailed description makes reference to a stereo audio program with a right and a left channel, the invention is also applicable to multiple channel (e.g., 5.1 channel) audio programs as well. Furthermore, instead Cartesian conversion for the image, other types of conversion may be used as well, including polar conversion, etc.

We claim:

1. A method of testing an audio program including at least a first audio and a second audio channel, said audio channels having polarity and phase, said method comprising:

generating a pseudo audio test signal formed of a first test and a second test channel said test channels defining respective first and second spatial coordinates of an unique asymmetrical image;

attaching said pseudo audio test signal to said audio program to form a combined audio program, said combined audio program having a combined first channel including said first audio channel and said first test channel and a combined second channel including said second audio channel and said second test channel;

recording said composite audio program on an audio media;

reading said composite audio program from said audio media;

detecting said pseudo audio test signal from said composite audio program; and displaying a reproduced image corresponding to said unique image, wherein said reproduced image has geometric and spatial characteristics that are indicative of one of said phase and polarity.

2. The method of claim 1 wherein said first and second test channels define orthogonal components for said image.

3. The method of claim 1 further comprising transmitting said combined program to another location.

4. A method of generating a visual indication indicative of a characteristic parameter of a multichannel audio program, said characteristic having one of a first value and a second value, said method comprising:

receiving said audio program with a test signal attached thereto, said test signal including a first and a second test channel, said test channels corresponding to channels of said audio program and being associated with a unique asymmetrical visual image; and displaying said unique image using said test channels, wherein the display image has spacial and geometric characteristics related to said characteristic parameter.

5. The method of claim 4 wherein said audio program and said test signal are recorded on an audio media and said step of receiving includes reading said audio program and said test signal from said audio media.

6. The method of claim 4 wherein said unique image is displayed using an X-Y display device having an X input and a Y input receiving said first and second test channels respectively.

7. The method of claim 6 wherein said test signal defines a pseudo audio signal with said first and second channels corresponding to a left and right stereo component.

8. The method of claim 4 further comprising inspecting said unique image as it is displayed to determine its spatial and geometric characteristics.

9. The method of claim 4 wherein said audio program includes a left and a right program channel and wherein said image is generated to have an orientation indicative of whether the left and right channels of the audio program are correctly recorded.

10. The method of claim 4 wherein said image is selected with dimensions and configurations that are indicative of an improperly recorded audio program when said image is displayed.

11. An audio test signal generator comprising:

a source of digital data corresponding to a unique asymmetrical graphic image;

a converter adapted to convert said digital data into a pseudo audio test signal; and a combining circuit arranged to combine an audio program and said pseudo audio test signal into a composite audio signal;

wherein said image is composed of two orthogonal components, and wherein said converter includes a first extractor adapted to extract one of said components and a second extractor adapted to extract the second of said components from said digital data; and wherein said audio program includes a left and a right program track and wherein said converter is adapted to convert said first and second components into respective left and right test tracks corresponding to said left and right program tracks.

12. A test signal generator adapted to generate a test signal for an audio program having a left and right program track, said test signal generator comprising:

memory means holding digital data descriptive of a unique two dimensional asymmetrical image selected to indicate at least one of a phase and polarity inversion when transmitted as an audio signal and defined by two spatial components; and converter means adapted to convert said digital data into a pseudo audio test signal having a left test track and right test track by extracting from said digital data said first spatial and second spatial component and generating said left and right test tracks from said first and second spatial component respectively.

13. The test signal generator of claim 12 wherein said converter means includes means for extracting an X-component from said digital data and means for extracting a Y-component from said digital data, and means for converting said X- and Y-components into said corresponding left and right test tracks.

14. The test signal generator of claim 13 further comprising multiplexer means adapted to combine said pseudo audio test signal with said audio program to generate a composite audio program.

15. The test signal generator of claim 13 further comprising normalizing means for normalizing said X- and Y-components to a range similar to the range of the audio program.

16. The test generator of claim 13 wherein said converter means further comprises a Cartesian converter for generating Cartesian coordinates from said digital data, said X- and Y-components corresponding to said Cartesian coordinates.

* * * * *